US006543776B2

(12) United States Patent
Macaluso

(10) Patent No.: US 6,543,776 B2
(45) **Date of Patent: *Apr. 8, 2003**

(54) FOLDABLE NET

(75) Inventor: Anthony G. Macaluso, Escondido, CA (US)

(73) Assignee: Dancorp Investors, Inc, Macedon, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/884,199

(22) Filed: Aug. 7, 2001

(65) Prior Publication Data

US 2002/0030324 A1 Mar. 14, 2002

Related U.S. Application Data

(63) Continuation of application No. 09/162,814, filed on Sep. 29, 1998, now Pat. No. 6,247,699, which is a continuation-in-part of application No. 08/899,906, filed on Jul. 24, 1997, now Pat. No. 5,842,940.

(51) Int. Cl.[7] ..... A63B 63/00

(52) U.S. Cl. ..... 273/400; 473/197; 473/454; 473/471

(58) Field of Search ..... 273/398–402, 273/395, 396; 473/476, 478

(56) References Cited

U.S. PATENT DOCUMENTS

| | | | |
|---|---|---|---|
| 920,907 | A | 5/1909 | Bolton |
| 3,001,795 | A | 9/1961 | Johnson, Jr. |
| D203,280 | S | 12/1965 | Pleasants |
| D205,040 | S | 6/1966 | Bruns |
| 4,336,942 | A | 6/1982 | Warehime |
| 4,373,734 | A | 2/1983 | Frank |
| 4,523,760 | A | 6/1985 | Bednarczuk |
| 4,905,996 | A | 3/1990 | Tallent et al. |
| 5,042,813 | A | 8/1991 | Huang |
| 5,088,740 | A | 2/1992 | Petersen |
| D333,689 | S | 3/1993 | Schleisner et al. |
| 5,244,213 | A | 9/1993 | Armell |
| 5,246,229 | A | 9/1993 | Carey |
| 5,269,527 | A | 12/1993 | Noval |
| 5,277,430 | A | 1/1994 | Naccarato |
| D346,838 | S | 5/1994 | Noval |
| 5,346,227 | A | 9/1994 | Amram et al. |
| 5,427,381 | A | 6/1995 | Macaluso |
| 5,433,433 | A | 7/1995 | Armell |
| 5,569,094 | A | 10/1996 | Macaluso |
| D384,382 | S | 9/1997 | Armell |
| 5,816,954 | A | 10/1998 | Zheng |
| 5,823,885 | A | 10/1998 | Stempfer |
| D403,386 | S | 12/1998 | Cho |
| 5,842,940 | A | 12/1998 | Macaluso |
| 5,976,023 | A | 11/1999 | Cho |
| 5,989,130 | A | 11/1999 | Macaluso |
| 6,135,894 | A | 10/2000 | Cho |

FOREIGN PATENT DOCUMENTS

| | | |
|---|---|---|
| WO | WO 85/02549 | 6/1985 |
| WO | WO 93/01866 | 2/1993 |

*Primary Examiner*—Mark S. Graham
(74) *Attorney, Agent, or Firm*—Neal L. Slifkin; Harris Beach LLP

(57) ABSTRACT

A foldable net includes a flexible frame that may be formed from a single wire or form a plurality of flexible tubes connected end-to-end. The frame is arranged to have an upper frame portion and a lower frame portion. The lower frame portion forms a base that supports the upper frame portion in a generally upright orientation on a generally horizontal surface with the base extending in a forward direction relative to the upper frame portion. A fabric section is connected to the frame and arranged for a projectile to be incident thereon. A plurality of straps is connected between portions of the frame to constrain it to a predetermined configuration for supporting the fabric in a position for receiving the projectile.

1 Claim, 7 Drawing Sheets

FOLDABLE NET

CROSS REFERENCE TO RELATED APPLICATION

This is a continuation of copending application Ser. No. 09/162,814 filed on Sep. 29, 1998, U.S. Pat. No. 6,247,699, which is a continuation-in-part of applicant's application Ser. No. 08/899,906, filed Jul. 24, 1997, U.S. Pat. No. 5,842,940.

BACKGROUND OF THE INVENTION

This invention relates generally to apparatus and methods that allow a person to practice hitting or throwing a ball or the like in a confined space without having the ball travel a large distance or hit other persons or objects and cause injury or damage.

SUMMARY OF THE INVENTION

The foldable net according to the invention has several advantages over the prior art. The foldable net preferably includes a frame that preferably comprises either a single wire or a plurality of flexible tubes connected end-to-end to form a segmented frame. The foldable net according to the present invention is easy to manufacture, sturdy, self-standing, easily collapsible for storage or transit and can be used indoors or outdoors. The single-wire embodiment of the frame requires no assembly. The segmented frame requires engagement of a male connector at one end of each frame segment with a corresponding female connector and connecting one or more straps between selected portions of the frame. After assembly, the segmented frame embodiment of the invention may be folded for storage without disassembly of the frame.

A foldable net structure according to the present invention comprises an elastic frame member arranged to have an upper frame portion and a lower frame portion. The lower frame portion forms a base that supports the upper frame portion in a generally upright orientation on a generally horizontal surface when the foldable net is in its erected configuration with the base extending in a forward direction relative to the upper frame portion. A fabric section is connected to the frame and arranged for a projectile to be incident thereon. In one embodiment of the invention, a pair of rear support members is connected to the frame and arranged to extend therefrom in a direction opposite to that of the lower frame portion. A pair of straps extend between the upper and lower frame sections to retain the upper and lower frame sections at a selected orientation with respect to one another.

The foldable net according to the present invention may include a fabric band that preferably extends between opposite sides of the frame to cooperate with the pair of straps to retain the upper and lower frame sections at the selected orientation with respect to one another. The foldable net according to the present invention may further comprise on or more weighted bags arranged to provide additional stability.

Each of the rear support members preferably further comprises a rod connected to the frame and a fabric connected to the rod and to the frame and arranged to provide support to the frame.

The rod preferably is connected to the frame by a mounting bracket. The mounting bracket may be removable from the frame when the net is to be folded. Alternatively, the mounting bracket may be rotatably mounted to the frame.

An alternate embodiment of the invention includes a flexible frame that includes a plurality of frame segments connected end-to-end and arranged to have an upper frame portion and a lower frame portion arranged so that the lower frame portion forms a base. A net is connected to the frame and arranged to span the interior area bounded by the frame and absorb the impact of a projectile directed into the interior area. Each of the frame segments preferably is formed as an elongate hollow tube with a flexible cord being placed lengthwise in the hollow tubes to arrange the frame segments in predetermined positions with respect to one another. A plurality of straps is connected to the frame to constrain the frame to a predetermined configuration to form the upper and lower frame portions.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
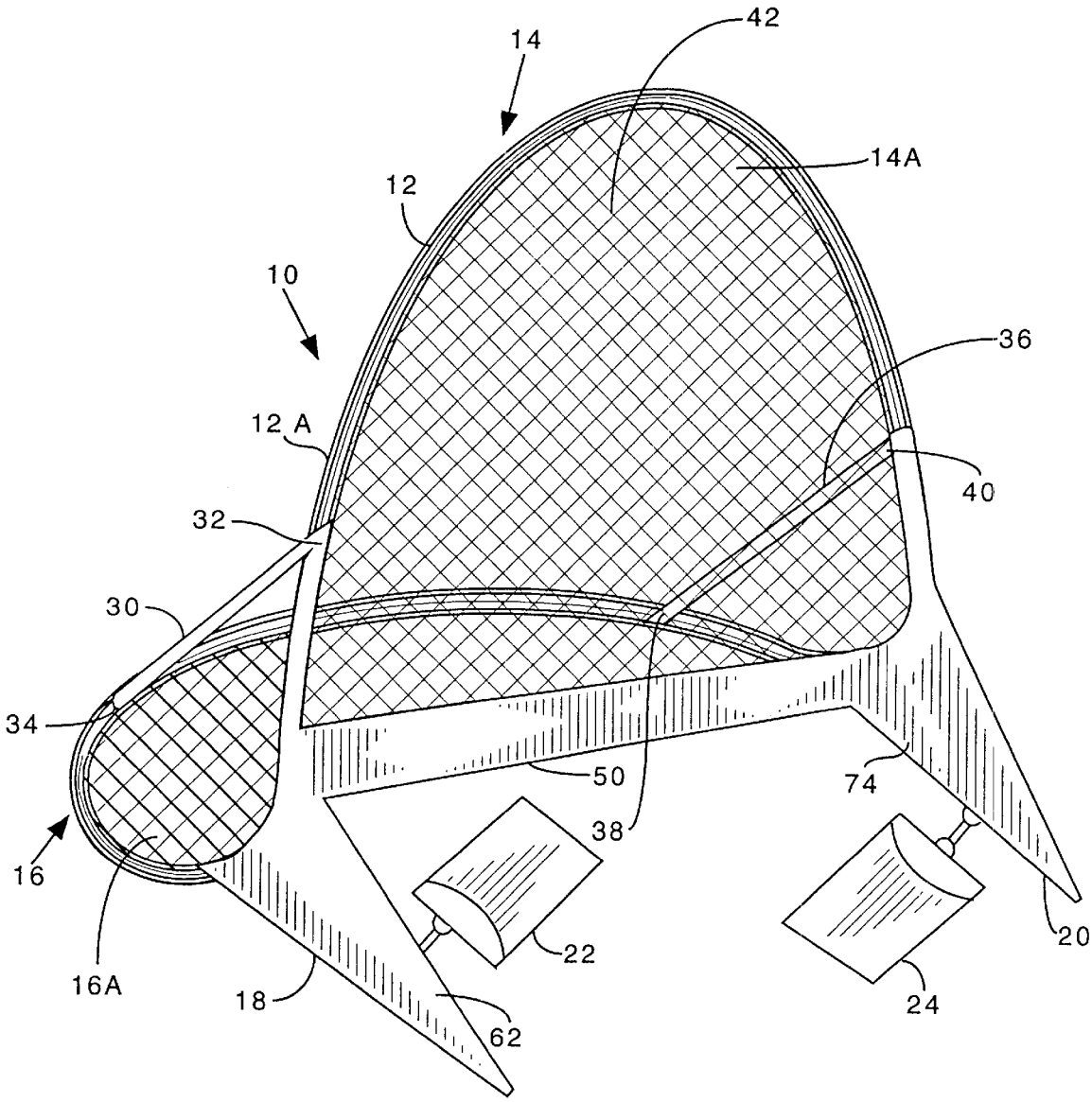
FIG. 1 is a perspective view showing a first embodiment of a frame and net structure that may be included in the present invention.
Figure 2:
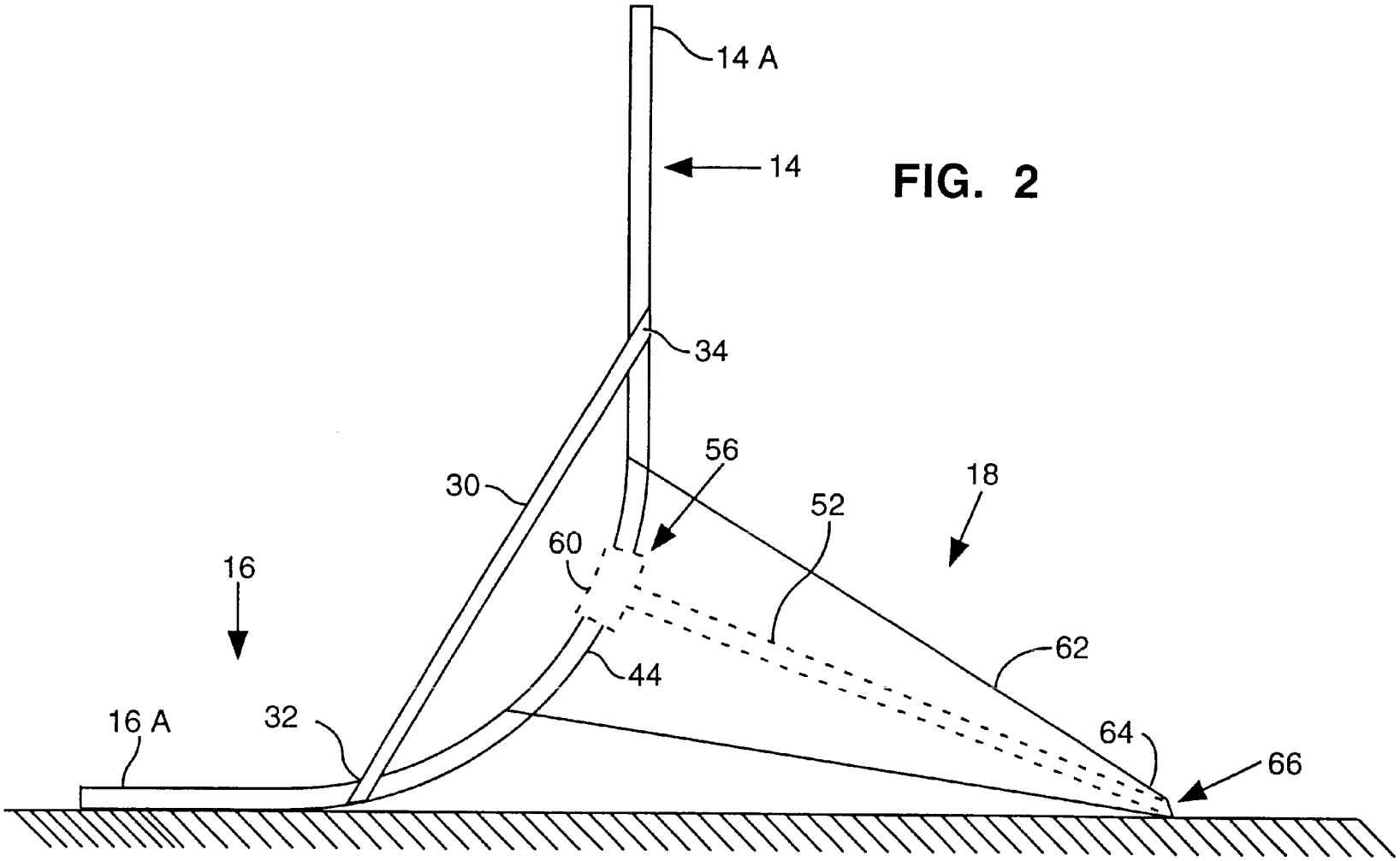
FIG. 2 is a side elevation view of the net of FIG. 1.
Figure 3:
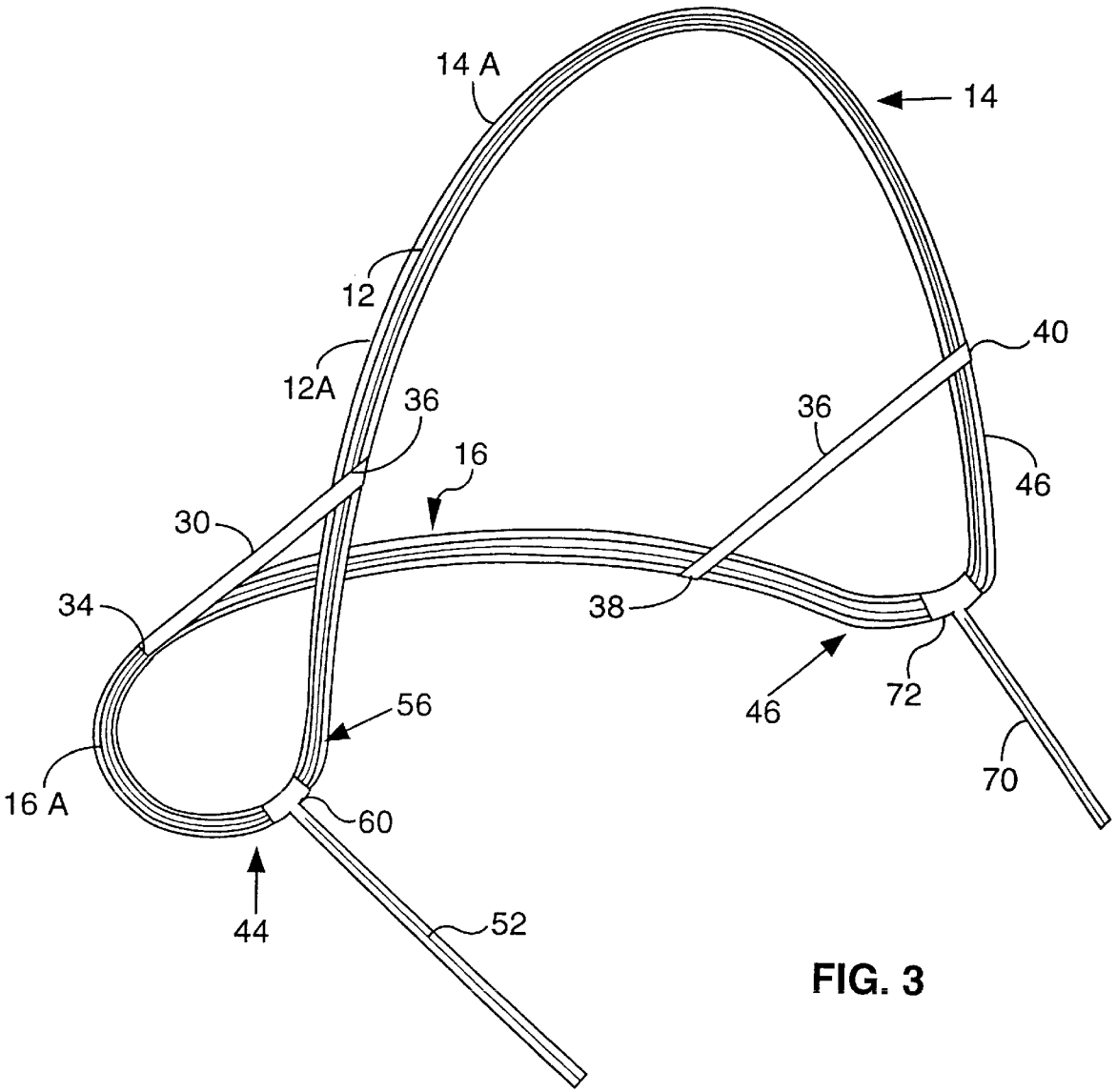
FIG. 3 is a perspective view illustrating a frame and support structure that may be included in the net apparatus of FIGS. 1 and 2.

Referring to FIGS. 1–3, a foldable net 10 comprises. a frame 12 that includes a wire frame member 12 that preferably is formed as a continuous loop. The wire frame member 12 is formed into an upper portion 14 and a base portion 16. A pair of rear supports 18 and 20 extend from the wire frame 12 and cooperate with the base portion 16 to hold the net 10 in an upright position when the net 10 is in use. A pair of weights 22 and 24 may be attached tot he rear supports 18 and 20, respectively, to aid in stabilizing the foldable net 10.

The wire frame 12 preferably is formed of steel spring wire. The ends of the wire frame member 12 preferably are connected together by any convenient means so that the frame member 12 is a continuous loop. The wire frame member 12 preferably is. placed inside a sleeve 12A or the like.

A first strap 30 extends between a first location 32 on one side of the front portion of the base 16 and a location 34 on the upright portion. The strap 30 is preferably connected to the sleeve 12A at the locations 32 and 34. The upper end of the strap 32 preferably is attached to the sleeve a distance of three to five feet above the lowest portion of the base 16. A second strap 36 extends between a location 38 on the base portion 16 opposite from the location 32 to a location 40 on the upright portion 14. The straps 30 and 36 preferably are formed of a suitable fabric or other similar material. The straps 30 and 36 and the sleeve 12A cooperate to hold the wire frame in the desired shape to form the base 16 and upright portion 14. As shown in FIGS. 1 and 3, the upright portion 14 and the base 16 and preferably have generally planar end portions 14A and 16A, respectively.

A fabric section 42 is connected to the sleeve 12A so that the entire region bounded by the wire frame 12 and sleeve 12A is covered by the fabric section 42. The fabric section preferably is formed of netting or the like and is arranged to absorb the impact of a projectile such as a golf ball, tennis ball, baseball, football or the like. The fabric section 42 absorbs the impact so that the projectile has no appreciable recoil velocity after it hits the fabric section 42. Instead of using the sleeve 12A, the net 42 may be attached to the wire frame 12 by means of straps or other convenient means.

The wire frame 12 has curved regions 44 and 46 that form a transition from the base 16 to the upright portion 14. The net 42 may be either loose hanging to stop the flight of a projectile such as a ball. Alternatively, the net 42 may be tautly mounted to the frame 12 so that the projectile is reflected. If the projectile is to be reflected, the angle between the base 16 and upright portion 14 may be any suitable angle for reflecting the projectile back generally in the direction from which it was traveling before striking the net 42.

A band 50 extends between the curved regions 44 and 46. The band 50 preferably is a few inches wide and serves to help retain the wire frame 12 in the desired configuration shown in FIG. 1. The band 50 preferably is formed of a suitable fabric.

The rear support member 18 includes a rod 52 that is mounted to the wire frame 12 at a location 56 that may be generally in the curved region 44. The rod 52 may be attached to the wire frame 12 by any convenient means such as a bracket 60 that encloses the wire frame 12. When the frame is erected, the rod 52 extends away from the wire frame 12. The rod 52 preferably is attached to a fabric section 62 that may be generally triangular in shape. The apex 64 of the triangular fabric section is formed by engaging the outer end 66 of the rod 52 with the fabric. The edges of the fabric section 62 are attached to the sleeve 12A by any convenient means such as stitching or hook and loop fasteners.

The rear support 20 includes a rod 70 that is connected to the frame 12 by a bracket 72. The rear support 20 includes a fabric section 74 that is essentially identical to the fabric section 62 of the first rear support member 18 and that is attached to the frame 12 in the same way as the fabric section 62.

The brackets 60 and 72 may be removable from the frame 12 when the net apparatus is to be folded for storage. The brackets 60 and 72 may alternatively be rotatable on the frame 12 when the net apparatus is to be stored. The support members 18 and 20 thus may be rotated toward the band 50 so that the wire frame 12 may be coiled when the net apparatus 10 is to be stored or transported.

Because of the memory of the frame 12 for the erected configuration, unless it is constrained, the spring forces in the frame members 12 will cause the multi-purpose net 10 to spontaneously assume the erected configuration. Therefore, the multi-purpose net 10 is self-erecting if the frame 12 is not constrained to some other configuration.

The first step in folding the foldable net 10 for storage is to pull the extreme edges of the upright portion 14 and the base 16 toward one another so that they are substantially adjacent so that the frame 12 is shaped generally as a "taco shell." The folding process continues by twisting the frame 12 to form a pair of loops, which may be then held close together and secured by a strap or the like. The multi-purpose net 10 is thus coiled up in a compact configuration suitable for storage or transport. The method of folding the foldable net 10 is essentially disclosed in U.S. Pat. No. 5,569,094, which issued Oct. 29, 1996 to the present inventor, Anthony G. Macaluso.

Figure 4:
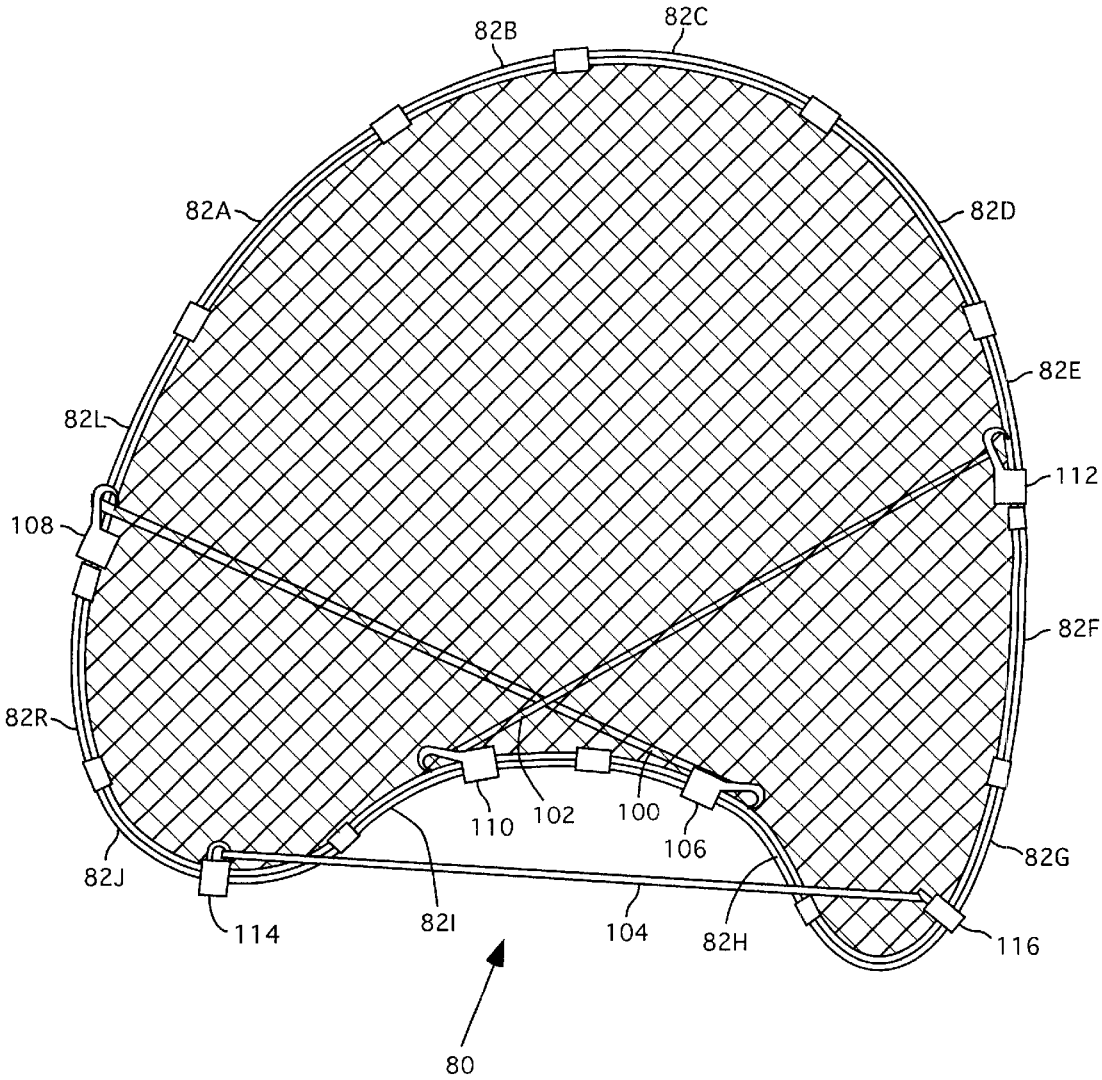
FIG. 4 is a perspective view of a second embodiment of a frame structure that may be included in the present invention.
Figure 7:
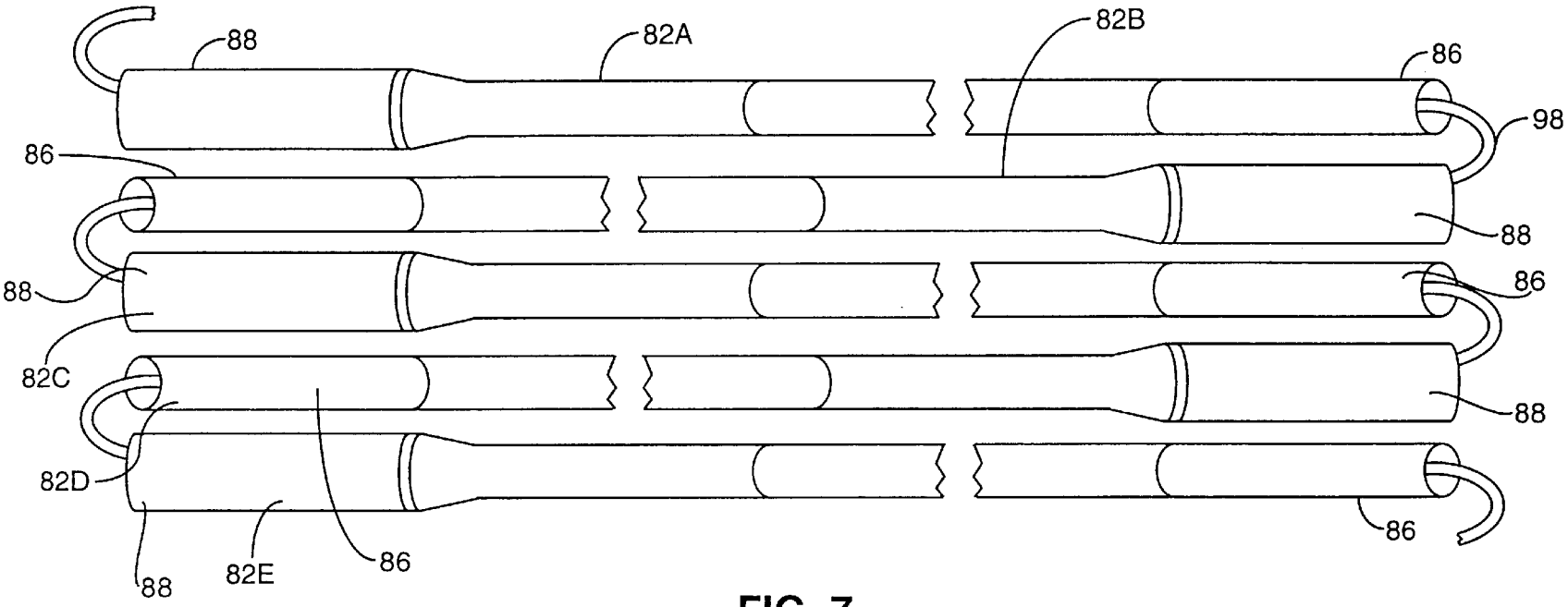
FIGS. 7–8 illustrates frame segments that may be used to form the frame of FIGS. 4–6.

FIG. 4 illustrates another embodiment of a frame 80 that may be included in a foldable net structure according to the present invention. The frame 80 is formed to include a plurality of separate frame segments 82A, 82B, etc. as best shown in FIG. 7. The frame segments each include a male connector portion 86 and a female connector portion 88.

The frame segments 82A, 82B, etc. are preferably formed as hollow tubes made of aluminum, steel, plastic or other suitable material. The frame segments 82A, 82B, etc. preferably have the same length. However, the frame 80 may be formed of frame segments having differing lengths. The segmented frame 80 has the advantage of permitting the use of more compact packaging than is generally possible with a continuous wire frame. Compact packaging saves shipping volume and conserves storage and shelf space.

Figure 8:
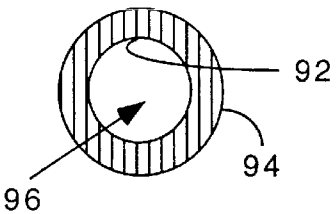

As shown in FIG. 8, each frame segment 82A, 82B, etc. has an inner wall 92, an outer wall 94 and a central cavity 96 that extends throughout the length of the frame segments. As shown in FIG. 7, a cord 98 extends through the centers of the tubular frame segments 82A, 82B, etc. The ends of the cord 98 are secured together so that the frame segments 82A, 82B, etc. are retained in a predetermined order on the cord 98 with the male end of each frame segment being adjacent the female end of the adjacent frame segment. For example, the male end of the frame segment 82A is adjacent the female end of the frame segment 82B. The cord 98 keeps the frame segments in proper order and relationship for easy assembly and also prevents any of the frame segments from being lost or separated from the frame assembly.

Assembly of the frame 80 involves placing the male ends of the 82A, 82B, etc. inside the corresponding female ends thereof. When the frame segments 82A, 82B, etc. are all connected, the frame 80 assumes a generally circular shape. A plurality of straps 100, 102 and 104 are connected to the frame 80 to constrain it so that when the frame is fully assembled, it assumes the shape of FIGS. 4–6. The strap 100 is connected to the frame 80 between a first lower strap connector 106 and a first upper strap connector 108. The strap 102 is connected to the frame 80 between a second lower strap connector 110 and a second upper strap connector 112. The strap 104 is connected to the frame 80 via a pair of strap connectors 114 and 116. The straps 100 and 102 thus are at angles to the horizontal, whereas the strap 104 is generally parallel to the horizontal when the frame is fully assembled and arranged to be upright for use.

The straps 100, 102 and 104 thus constrain the frame 80 to have a base portion 118 that rests upon the ground, for example, when the foldable net is arranged for use. The frame 80 further includes an upper portion 120 that extends generally upward from the base portion 118. A net 122 is connected to the frame 80. Any suitable fastening device may be used to connect the net 122 to the frame 80. In one preferred embodiment of the invention, a plurality of snap connectors are mounted to the net 122 and then snap-connected to the frame 80.

Figure 5:
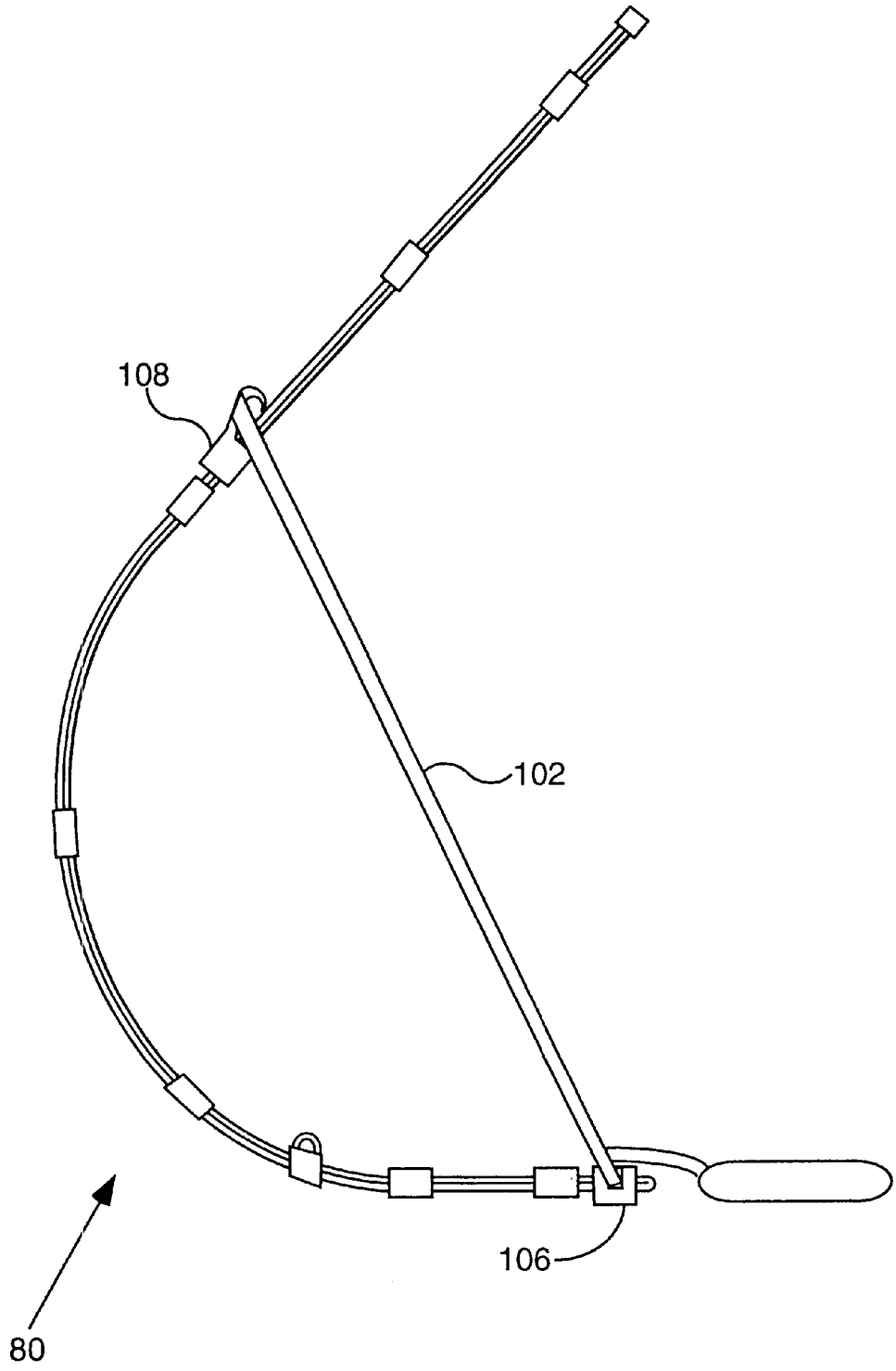
FIG. 5 is a side elevation view of the frame structure of FIG. 4.
Figure 6:
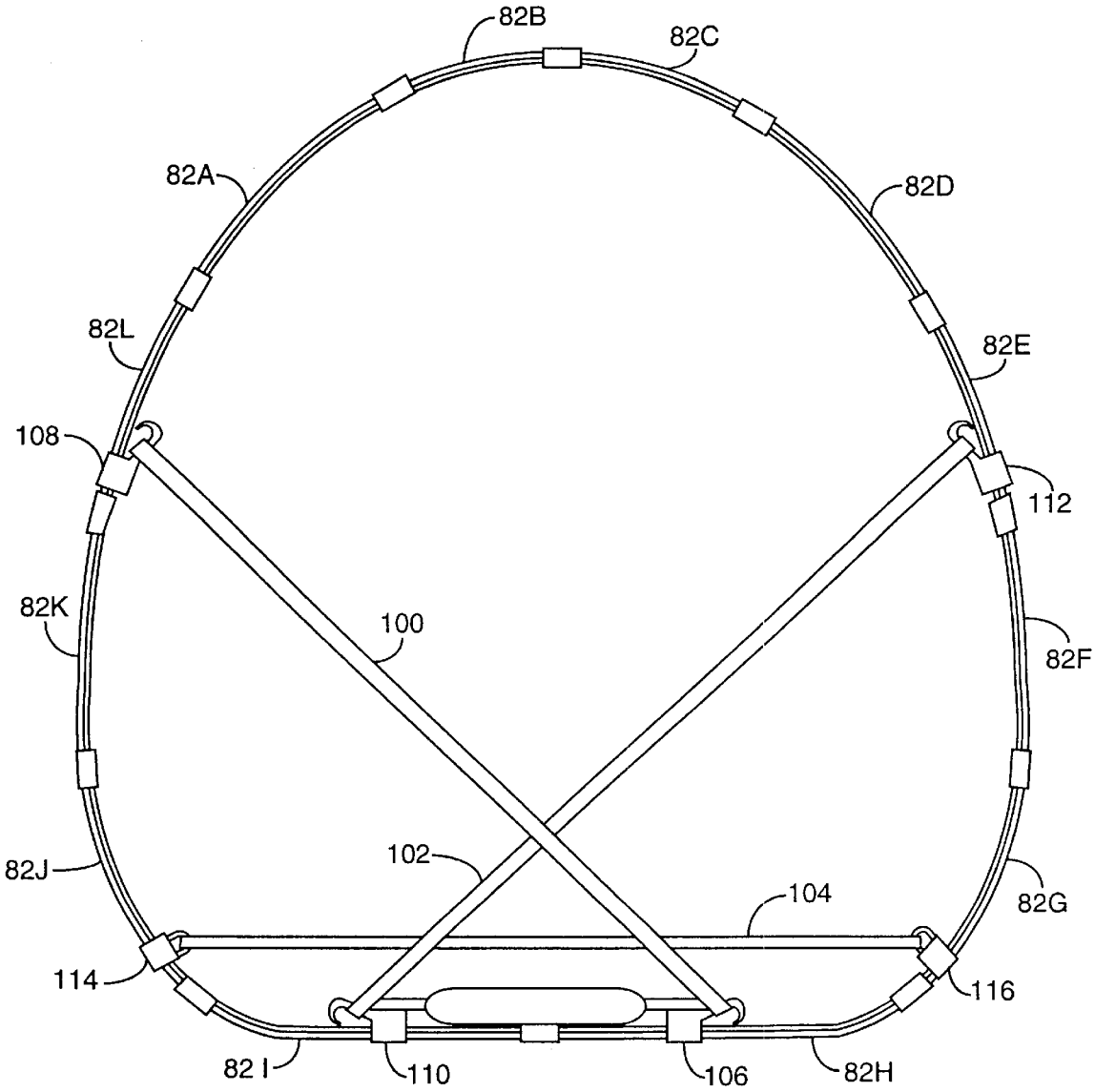
FIG. 6 is a front elevation view of the frame structure of FIG. 4.

The frame 80 is designed to stand erect without requiring legs as in the first embodiment described above with reference to FIGS. 1–3. As shown in FIGS. 5 and 6, a bag 130 may be attached to the base portion of the frame 80. Objects may be placed in the bag 130 for storage or to provide weight for stabilizing the net structure.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. AU modifications to the embodiments described herein that come within the meaning and range of equivalence of the claims are embraced within the scope of the invention. The foregoing detailed description is to be clearly understood as given by way of illustration and example only, the spirit and scope of this invention being limited solely by the appended claims.

What is claimed is:

1. A foldable net structure for erection on a generally horizontal surface and use in an activity involving a projectile, comprising:

an elastic frame member arranged to have an upper frame portion and a lower frame portion, the lower frame portion forming a base that helps support the upper frame portion in a generally vertical orientation when the net structure is in its erected configuration;

a sleeve connected to the frame member substantially completely around the periphery of the frame member;

a net connected to the sleeve and arranged to span the interior area bounded by the frame member and absorb the impact of a projectile directed into the interior area; and a pair of rods connected tooth sleeve, extending to the generally horizontal surface and arranged to cooperate with the base to hold the upper frame portion in its generally vertical orientation.

* * * * *